US005103659A

United States Patent [19]

Benefield, Sr.

[11] Patent Number: 5,103,659

[45] Date of Patent: Apr. 14, 1992

[54] LOCKING DEVICE FOR MAILBOXES

[76] Inventor: James Benefield, Sr., 133 E. 140th St., Los Angeles, Calif. 90061

[21] Appl. No.: 472,652

[22] Filed: Jan. 30, 1990

Related U.S. Application Data

[63] Continuation-in-part of Ser. No. 289,715, Dec. 27, 1988, abandoned, which is a continuation-in-part of Ser. No. 191,045, May 6, 1988, abandoned.

[51] Int. Cl.[5] ..... E05B 13/00

[52] U.S. Cl. ..... 70/94; 70/423; 70/164; 292/340; 232/25; 312/216

[58] Field of Search ..... 70/14, 57, 58, 62, 63, 70/94, 114, 158, 159, 164, 166, 167, 230, 416, 417, 423, 424, 427, 428, 455; 312/216, 107.5; 232/17, 24, 25, 45; 292/32, 340, 341

[56] References Cited

U.S. PATENT DOCUMENTS

| | | | |
|---|---|---|---|
| 630,505 | 8/1899 | Hicks | 312/216 X |
| 1,208,061 | 12/1916 | Wheary | 312/216 |
| 1,218,821 | 3/1917 | Williams | 312/216 X |
| 1,259,345 | 3/1918 | Beecham | 312/216 X |
| 2,297,579 | 9/1942 | Norberg | 70/164 X |
| 2,562,094 | 7/1951 | Helling | 292/340 |
| 2,794,663 | 6/1957 | Grodt et al. | 292/340 X |
| 2,803,512 | 8/1957 | Band | 312/216 X |
| 2,832,529 | 4/1958 | Brown | 232/25 |
| 3,797,005 | 3/1974 | Schwarz | 70/94 X |
| 4,006,324 | 2/1977 | Leasher et al. | 70/DIG. 30 X |
| 4,135,376 | 1/1979 | Evans et al. | 70/94 X |
| 4,455,846 | 6/1984 | Wichinsky | 70/94 |
| 4,648,550 | 3/1987 | Cleary, Jr. | 232/25 |
| 4,669,767 | 6/1987 | Leto | 70/94 X |
| 4,796,445 | 1/1989 | Norden, Jr. | 70/94 |

*Primary Examiner*—Robert L. Wolfe
*Assistant Examiner*—Suzanne L. Dino
*Attorney, Agent, or Firm*—Julius Rubinstein

[57] ABSTRACT

A mail box for an apartment building comprising a number of individual mail boxes corresponding to the number of tenants. Each mail box has an individual mail box lock. Releasable locking means are connected to the mail boxy for covering the individual mail box locks until mail is to be removed to prevent theft. Unlocking means are provided for unlocking the releasable locking means to expose the individual tenants lock so they can get their mail.

4 Claims, 3 Drawing Sheets

LOCKING DEVICE FOR MAILBOXES

This is a continuation in part of patent application Ser. No. 289,715 filed Dec. 27, 1988 which is itself a continuation in part of patent application Ser. No. 191,045 filed May 6, 1988 by James Benefield Sr. and now abandoned.

This invention relates to a mailbox lock and more particularly to a burglar-proof device for covering and protecting multiple mail box locks used in apartment buildings.

BACKGROUND AND BRIEF SUMMARY

In recent years the theft of mail from mail boxes in apartment buildings has increased enormously. One of the prime reasons for these felonious acts is that the number of tenants who receive monthly social security, dividend, and interest checks has risen dramatically. Since the locks on the doors of the individual mail boxes are rather flimsy, it is not difficult to pry them open. As a consequence the incidence of mail box robberies, particularly at times of the month when social security checks or income tax refund checks are due, has increased substantially.

What is needed, therefore, and comprises an important object of this invention is to provide a means for simultaneously locking and covering all the locks in the individual mail boxes in an apartment building as a way to prevent these thefts.

To do this, a lock bar formed from a hardened and tempered steel is removably mounted on the support frame of the mail box so it can be moved to cover each tenant's mail box lock in an apartment building. The lock bar is removably locked into position by a very strong lock. Consequently the tenants of the building would be provided with two keys; one for the strong lock for opening the lock bar, and the other for opening their individual mail box.

This and other objects of this invention will become more apparent when better understood in the light of the accompanying specification and drawings wherein.

Figure 9:
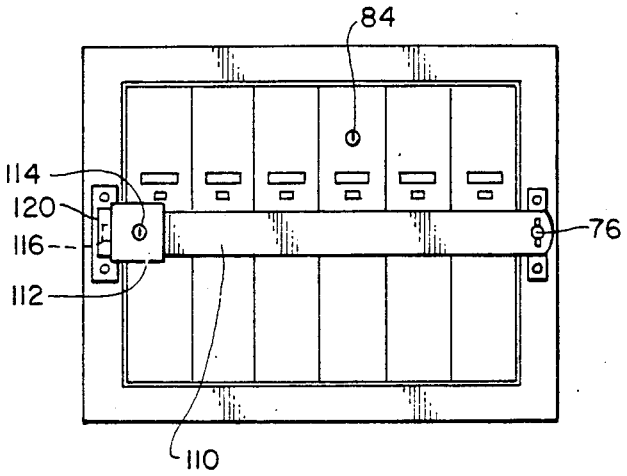
FIG. 9 is a modification of the mail box locking device wherein the housing on the end of the locking bar has a specially designed lock, designed so the mailman's key can open both the mail box lock and the lock on the housing.
Figure 10:
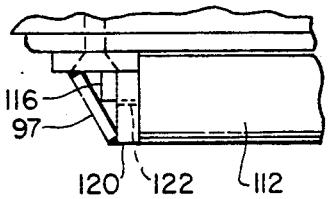

FIG. 10 discloses a single bolt receiving recess for use with the lock disclosed in FIG. 9.

Figure 11:
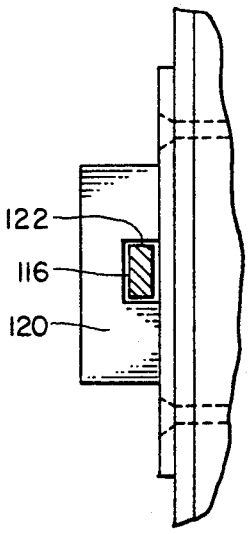

FIG. 11 discloses a side elevational view of the hasp designed to receive the single tongue of the lock shown in FIG. 9.

Figure 12:
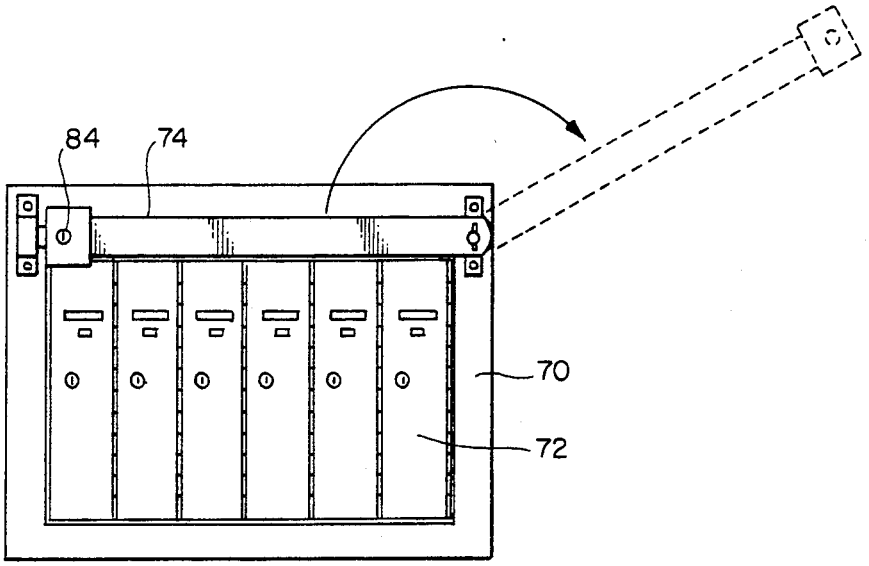

FIG. 12 discloses another modification of the mail box wherein the locking bar is attached to the upper end of the support frame, and covers the upper part of the second frame, so that while the locking bar is in position, the second frame and the tenants mail boxes cannot pivot forward.

Figure 13:
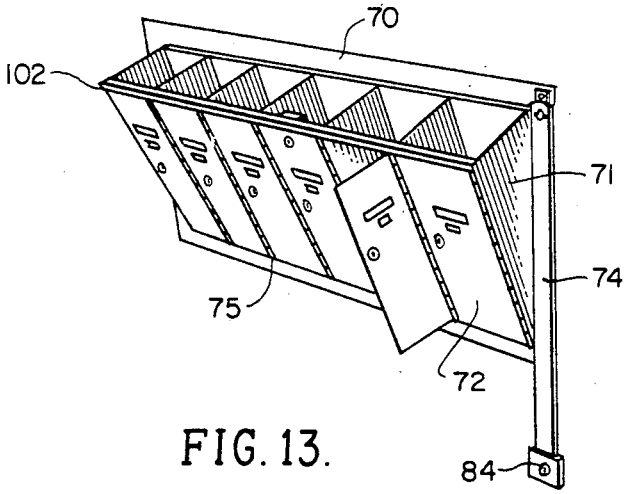

FIG. 13 discloses the mail box shown in FIG. 12, wherein the upper lock bar has been pivoted out of the way permitting the second frame to pivot forward and exposing the tops of the individual mail boxes.

Figure 14:
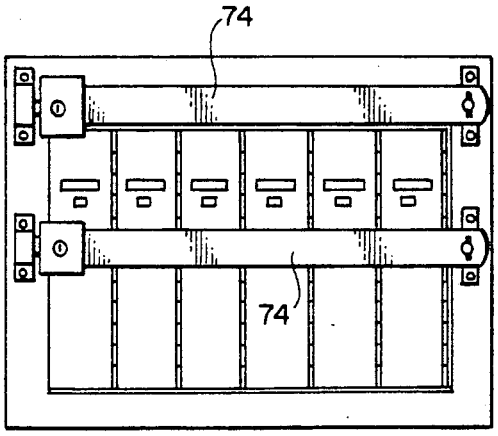

FIG. 14 discloses still another modification of the mail box shown in FIG. 12 but with an added bar covering the tenant's mail box locks.

Figure 1:
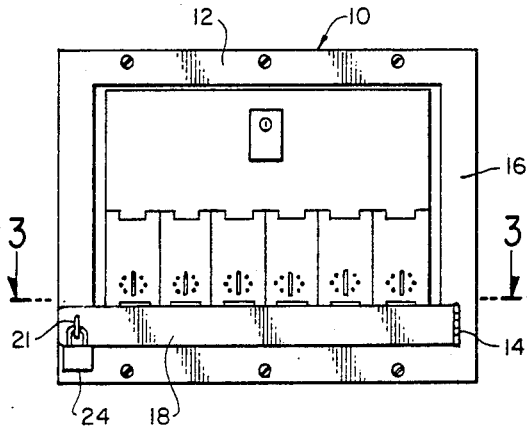
FIG. 1 is an elevational view of one embodiment of a mail box for an apartment building, showing a lock bar in a closed position covering all the individual mail box locks.

Referring now to FIG. 1 Of the drawing, a group of mail boxes 10 for an apartment building is mounted on a support frame 12 secured to the wall of the building secured by any suitable means.

The means for protecting the group of tenant mail boxes 10 comprise a hinge 14 mounted on side 16 of the frame 12. A lock bar 18 formed from hardened steel is pivotally mounted on the hinge 14.

Figure 2:
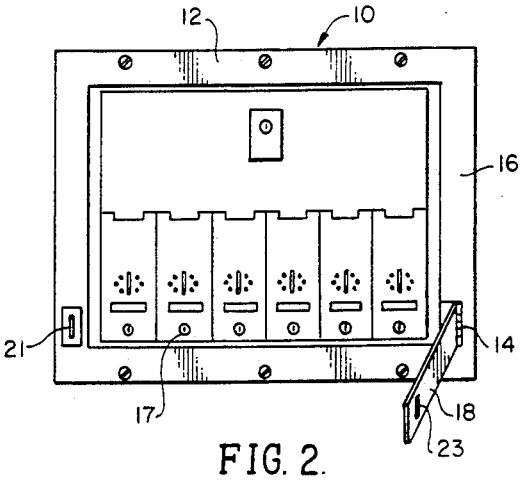
FIG. 2 is a view similar to FIG. 1 showing the lock bar in an open position exposing the individual mail box locks.
Figure 3:
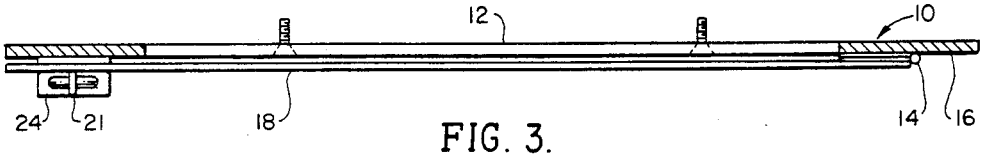
FIG. 3 is a sectional view taken on the line 3—3 of FIG. 1.

As seen in FIGS. 1, 2 and 3, the lock bar 18 as positioned in FIG. 1, covers and protects the locks 17 on the tenants mail boxes 10 which when left exposed are easy to break open. When the lock bar 18 is in the open position shown in FIG. 2, the mail box locks are exposed enabling the tenants to open their individual mail boxes. A hasp comprising a staple 21 welded to the outer frame 12 as shown in FIGS. 1 And 2 and a hasp slot 23 is provided. The hasp staple 21 engages the hasp slot 23 formed in the end of the lock bar 18, so that the hasp staple 21 can extend through the hasp slot 23 in the end of the lock bar 18 permitting a very strong lock 24 to be attached through the staple 21 thus holding the lock bar 18 locked as shown covering the individual mail box locks 17, see FIG. 1.

To open the lock bar 18 the tenant must carry an extra key for unlocking the lock 24 and disengaging the lock bar 18 to expose the individual mail box locks 17.

Figure 4:
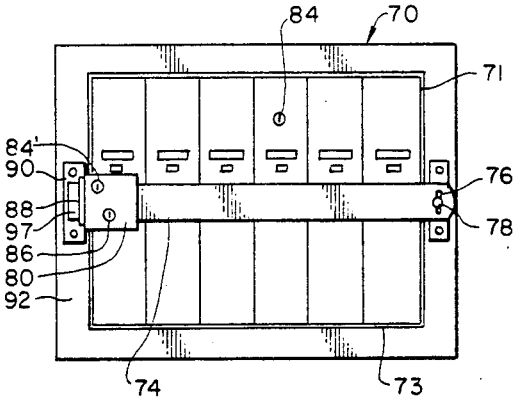
FIG. 4 is a modified mail box wherein the tenant's mail boxes are mounted in a second frame which extends from the top of said second frame to the bottom of the second frame, and where the second frame is pivotally mounted to a surrounding support frame at the base of the support frame.
Figure 5:
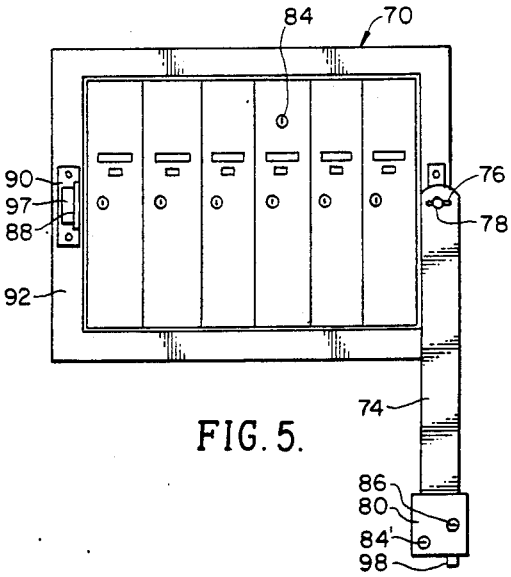
FIG. 5 is a view of the mail box shown in FIG. 4, but with the mail box lock bar pivoted to a vertical position exposing the individual mail box locks.

FIG. 4 discloses a more modern apartment house mail box mounted in an outer support frame indicated generally by the reference numeral 70. The individual tenants mail boxes 72 are mounted in an inner frame 71 see FIG. 13. These mail boxes extend from the top of frame 71 to the bottom of the frame thus holding more mail. Frame 71 is pivotally connected at its lower end 73 to the outer frame 70. A locking bar 74 made from tempered steel is provided with a transverse slot 76 at one end through which a stud 78 extends so the locking bar can pivot on said stud. The stud 78, see FIG. 5 is embedded in one side of the outer frame 70. A housing or lock box 80 holding two locks, 84 and 86 is secured to the opposite end of the locking bar 74 see FIG. 4. Lock 82 is the same as lock 84 so that the key carried by the postman can open it.

The lock 86 can be opened by a key carried by the tenants. Lock 86 is mounted in the lock box 80 and controls the tongue 98 shown in FIG. 7 so that the tenants can move the locking bar 74 out of the way so they can get at their mail.

A t-shaped abutment or hasp 88 is welded to a mounting plate 90 secured to the edge 92 of the outer frame 70 opposite to where the stud 78 is attached.

Figure 7:
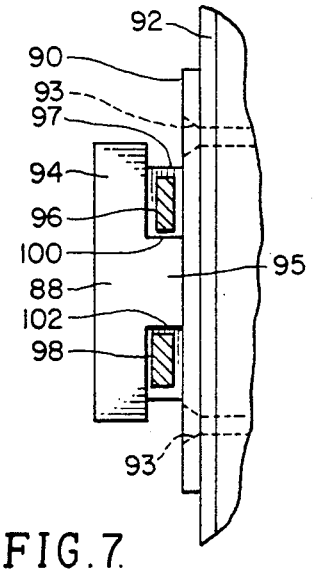
FIG. 7 is a side elevational view of the T-shaped hasp shown the engagement of the separate tongues or slide bolts of the locks which when retracted permit the locking bar to be pivoted upwardly or downwardly to expose the key holes of the tenant's mail boxes.
Figure 8:
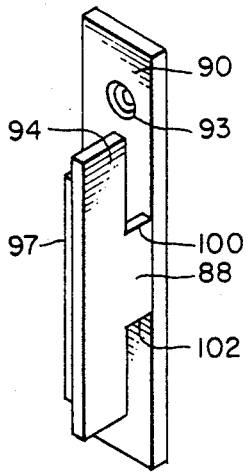
FIG. 8 is a perspective view of the hasp shown in FIG. 7.

The t-shaped abutment 88 extends out from the side 92 of frame 73 and as seen in FIG. 7, the tongues 96 and 98 of locks 84' and 86 which when extended lie between frame 92 and the head 94 of the t-portion of the abutment 88.

When the locks 84' and 86 are actuated the tongue 96 of lock 84' and tongue 98 of lock 86 are extended out into their locking position. Tongue 96 abuts the upper abutting surface 100 of the stem 95 of the t-shaped abutment while tongue 98 extends out and abuts abutting surface 102 of the stem 95 of the t-shaped abutment 88.

With this arrangement the bar 74, with the lock box 80 attached and the tongues 96 and 98 extended, cannot be pivoted in either direction. But when the postman comes he can open lock 84 and lock 84' on the lock box 80 with the same key with the same key. This retracts tongue 96 out of its recess so that the lock box 80 with the bar 74 can be pivoted upward out of the way of the individual mail boxes and the postman can open the control lock 84 and pull open all the mail boxes simultaneously in order to deposit the individual apartment mail (see FIG. 13.) In addition, when tongue 96 of the postman's lock is extended, a tenant can come and insert his key in lock 86 and retract tongue 98 so that the lock box 80 and the bar 74 can be pivoted in the opposite direction out of the way as shown in FIG. 5, to expose the individual mail box locks.

Figure 6:
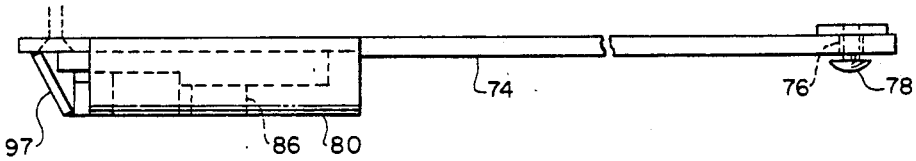
FIG. 6 is a side elevational view of the lock bar shown in FIG. 4.

To prevent thieves from hammering in the extended tongues 96 and 98, a protective strip 97 of tempered metal is welded both to the bar 74 and to the top portion 96 of the t-shaped abutment 88. This as shown in FIG. 6 protects the outer ends of the tongues or sliding bolts, 96 and 98 from being forced into a retracted position.

A modified bar 110 is disclosed in FIG. 9. In this modification a special lock in the lock box 112 is mounted at the end of the bar 110 opposite the pivot 76 has only one lock 114. This lock controls sliding bolt or tongue 116. The lock 114 is designed so it can be operated by both the mailman's and the tenant's keys but the keys carried by the tenants cannot open lock the special postman's lock 84 while the postman's key can unlock both the main post box lock. Of course this requires the abutment 120 to be modified because there is only one tongue 116. For that reason the abutment 120 mounted on the side 92 of the frame 70 opposite the pivot 76 has a single tongue receiving recess 122, see FIGS 10 and 11.

The tongue when extended prevents the lock bar 110 from being pivoted in either direction. But when the lock 114 is actuated, the tongue 116 is retracted permitting the lock bar to be pivoted in any direction, up or down thereby exposing tenants individual mail box locks so the tenants can open their mail boxes.

The mail box shown in FIG. 13 comprises an outer frame 70 secured to the wall of the building by studs or any other suitable means and an inner frame 71. The individual tenant mail boxes 72 are mounted as a unit in a frame 71. Frame 71 has a top bar 102, see FIG. 16, and a bottom strip 75. This strip is pivotally connected to the base of the outer frame 73, so that the inner frame and all the individual mail boxes can pivot forward revealing their open tops, see FIG. 13.

In the ordinary mail box of this type, when the mail man unlocks the mail box lock 84, the inner support frame 71 with its entire group of tenant mail boxes 72 pivot forward as shown in FIG. 16 exposing the open tops of all the mail boxes in the inner frame 71. However as a further protection, Frame 71 has a top bar 102 see FIG. 13. A lock bar 74 is mounted at the top of frame 73, see FIGS. 13 and 14 and when the lock bar 74 is in a locking position, as shown in FIGS. 13 and 14. The thickness of the lock bar 74 is such that it covers the lower part of the top bar 102 of frame 71 see FIG. 12. With this arrangement, the postman cannot open the mail boxes until he first opens the lock 84 on the bar lock bar 74.

Then as shown in FIG. 12, he can pivot the lock bar 74 out of the way of the top bar 102. Then when he unlocks the regular postman's lock 84 on the inner frame 71 which has the same lock 84' as the lock on the lock box 80 as shown in FIG. 4. The individual mail boxes 72 pivot forward as shown in FIG. 13. Then he can insert the mail and fill the tenant'mail boxes. Then the individual mail boxes can open because they are on frame 71, and are not covered by bar 74. In this way the tenants can open their individual mail boxes when frame 71 is locked to its support bar 74.

If circumstances require more protection, two lock bars 74 and 74' can be used, see FIG. 14. Lock bar 74' presses against and covers and conceals the individual mail box locks as shown in FIG. 14 to prevent access by thieves, so that thieves cannot pry open the individual mail box locks.

Having described the invention, what I claim as new is:

1. A mail box for an apartment building comprising a support, said support having an upper portion and a lower portion, individual mail boxes mounted on said support, each individual mail box extending from the lower portion of the support to the upper portion, said group of mail boxes having an upper end and a lower end, the lower end of said group of mail boxes pivotally connected to said lower portion of said support, said group of mail boxes having an open top concealed when the mail boxes are held against said support, a postman's lock mounted on said mail boxes in such a way that when the postman's lock is in a locked position, the group of mail boxes are held against said support and when the postman unlocks the postman's lock, the group of mail boxes pivot forward to expose the open tops of the mail boxes so the postman can insert mail in the group of all boxes, each individual mail box having a lock which can be opened by a tenant, a lock bar, one end of said lock bar movably connected to one side of said support and movable to a position where it abuts and presses against the outer surface of the individual mail boxes completely covering each individual mail box lock and extending below each individual mail box a distance sufficient to prevent thieves from inserting tools underneath the lock bar and prying the mail boxes open, locking means for releasably locking the lock bar in said position, said locking means comprising a lock box on the end opposite said one end of said lock bar, a pair of locks mounted on the lock box for extending or retracting at least one tongue actuated by an associated lock, a t-shaped abutment secured to the opposite side of said support, said abutment having tongue receiving recesses defined by the stem of said t and positioned so when said locks are actuated, said tongues in said lock box extend out into said recesses in said abutment so that as long as the tongues are extended, the lock bar cannot be moved to expose the individual mail box locks, one of said locks on the lock box designed so said postman's key can open both the postman's lock and said lock on the lock box to retract or extend said tongue into or out of said recess, each tenant having a key designed to open the other lock in said lock box to retract or extend said tongue out of said recess, said postman's lock designed so said tenant's key cannot open the postman's lock whereby when the postman's key opens the postman's lock and actuates the lock on said lock box to retract said tongue he can move the lock bar in one direction out of the way permitting the individual mail boxes to pivot forward exposing their open tops permitting them to be filled with mail, while the individual tenant's key can only open the other lock on the lock box to retract or extend said tongue so the lock bar can be moved in another direction out of the way to expose the individual locks on said mail boxes.

2. A mail box for an apartment building comprising a group of pivotally mounted mail boxes mounted on a frame, said mail boxes having an open top concealed when the mail boxes are held against the said frame, a postman's lock mounted on said mail boxes in such a way that when the postman's lock is in a locked position the individual mail boxes are held against the frame and when the postman unlocks the postman's lock the group of individual mail boxes pivot forward to expose the open tops of the mail boxes so the postman can insert mail in the group of mail boxes, each individual mail box having a lock which can be opened by a tenant, a lock bar formed from tempered steel, one end of said lock bar pivotally connected to one side of said frame and movable to a position where it abuts the outer surface of the individual mail boxes completely covering each individual mail box lock to prevent thieves from breaking the mail box locks and prying the mail boxes open, locking means for releasably locking the lock bar in said position, said locking means comprising a lock box on the opposite end of said lock bar, at least one lock mounted in the lock box for extending or retracting at least one tongue, an abutment secured to the opposite side of said frame, said abutment having at least one tongue receiving recess positioned so when said lock is actuated at least one tongue in said lock box extends out into said at least one recess in said abutment so that as long as the tongue is extended, the lock bar cannot be pivoted up or down to expose the individual mail box locks, said lock on the lock box designed so said postman's key can open both the postman's lock and said lock on the lock box to retract or extend said tongue into or out of said recess, each tenant having a key designed to open said lock in said lock box to retract or extend said tongue out of said recess, said postman's lock designed so that tenant's key cannot open the postman's lock whereby when the postman comes, his key can open the postman's lock and actuate the lock on said lock box to retract or extend said tongue so he can retract said tongue and pivot the lock bar out of the way permitting the individual mail boxes to pivot forward exposing their open tops and permitting them to be filled with mail, while the individual tenant's key can only open the lock on the lock box to retract or extend said tongue so the lock bar can be pivoted out of the way to expose the individual locks on said mail boxes, said abutment mounted on one end of said lock bar being t-shaped, a pair of tongue receiving recesses defined by the stem of said t-shaped abutment, said locking means comprising a pair of locks mounted in said lock box, each lock controlling a tongue and when one lock is actuated said tongue can extend out into said excess and abut the upper abutting surface of said stem and when the other lock is actuated its tongue can extend out into said recess and abut the lower abutting surface of said stem, so when the tongues are extended, the lock bar cannot be pivoted in either direction, said postman's key fitting both the postman's lock and one of the locks on said lock box so the tongue controlled by said lock can be retracted permitting said lock bar to be pivoted in one direction out of the way to permit the individual mail boxes to pivot forward exposing their open tops and permitting them to be filled with mail and at the same time exposing the locks on the individual mail boxes, while the tenant's key fits only the other lock on said lock box so the tongue controlled by said lock can be retracted permitting said lock bar to be pivoted in the opposite direction exposing the locks on the tenant's mail boxes so the tenants can open their own small box.

3. A mail box for an apartment building comprising a support frame, said frame having an upper portion and a lower portion, individual mail boxes mounted on said frame, each individual mail box extending from the lower portion of the support to the upper portion, said group of mail boxes having an upper end and a lower end, the lower end of said group of mail boxes pivotally connected to said lower portion of said support, said group of mail boxes having an open top concealed when the mail boxes are held against said support, a postman's lock mounted on said mail boxes in such a way that when the postman's lock is in a locked position, the group of mail boxes are held against said support and when the postman unlocks the postman's lock the group of mail boxes pivot forward to expose the open tops of the mail boxes so the postman can insert mail in the group of mail boxes, each individual mail box having a lock which can be opened by a tenant, a lock bar formed from tempered steel, one end of said lock bar pivotally connected to one side of said support and movable to a position where it abuts the outer surface of the individual mail boxes completely covering each individual mail box lock to prevent thieves from breaking the mail box locks and prying the mail boxes open, locking means for releasably locking the lock bar in said position, said locking means comprising a lock box on the opposite end of said lock bar, at least one lock mounted in the lock box for extending or retracting at least one tongue, an abutment secured to the opposite side of said support, said abutment having at least one tongue receiving recess positioned so when said lock is actuated at least one tongue in said lock box extends out into said at least one recess in said abutment so that as long as the tongue is extended, the lock bar cannot be pivoted up or down to expose the individual mail box locks, said lock on the lock box designed so said postman's key can open both the postman's lock and said lock on the lock box to retract or extend said tongue into or out of said recess, each tenant having a key designed to open said lock in said lock box to retract or extend said tongue out of said recess, said postman's lock designed so that tenant's key cannot open the postman's lock, whereby when the postman comes, his key can open the postman's lock and actuate the lock on said lock box to retract or extend said tongue so he can retract said tongue and pivot the lock bar out of the way permitting the individual mail boxes to pivot forward exposing their open tops and permitting them to be filled with mail, while the individual tenant's key can only open the lock on the lock box to retract or extend said tongue so the lock bar can be pivoted out of the way to expose the individual locks on said mail boxes, said abutment mounted on one end of said lock bar—being t-shaped, a pair of tongue receiving recesses defined by the stem of said t-shaped abutment, said locking means comprising a pair of locks mounted in said lock box, each lock controlling a tongue and when one lock is actuated said tongue can extend out into said excess and abut the upper abutting surface of said stem and when the other lock is actuated its tongue can extend out into said recess and abut the lower abutting surface of said stem whereby the lock bar cannot be pivoted in either direction, said postman's key fitting both the postman's lock and one of the locks on said lock box so the tongue controlled by said lock controlled by said postman can be retracted permitting said lock bar to be pivoted in one direction out of the way to permit the individual mail boxes to pivot forward exposing their open tops and permitting them to be filled with mail and at the same time exposing the locks on the individual mail boxes, while the tenant's key fits only the other lock on said lock box so the tongue controlled by said other lock can be retracted permitting said lock bar to be pivoted in the opposite direction exposing the locks on the individual mail boxes so the tenants can open their own small box.

4. A mail box for an apartment building comprising a group of pivotally mounted mail boxes mounted on a support, a postman's lock for the mail boxes, said mail boxes having an open top concealed when the mail boxes are held against the said support until the postman unlocks the postman's lock permitting the group of mail boxes to pivot forward to expose the open tops of each of the mail boxes so the postman can insert mail in the group of mail boxes, each individual mail box having a lock which can be opened by a tenant, a lock bar movably mounted at one end at least adjacent one side of said group of mail boxes and movable to a locking position where it abuts and presses against the outer surface of the individual mail boxes completely covering and concealing each individual mail box lock to prevent a thief from inserting a tool beneath said lock bar to pry open the individual mail boxes, locking means for releasably locking the lock bar in said locking position, said locking means comprising a lock box mounted on the end of said lock bar opposite said one end, a pair of locks mounted on said lock bar, each lock controlling a tongue and adapted to extend or retract a tongue when the lock is actuated, a t-shaped abutment secured to the opposite side of said support, the stem of said t-shaped abutment defining tongue and adapted to extend or retract a tongue when the lock is actuated, a t-shaped abutment secured to the opposite side of said support, the stem of said t-shaped abutment defining tongue receiving recesses positioned so when said locks are actuated causing said tongues to extend out into said recesses defined by the stem of said abutments the lock bar cannot be moved out of the locking position to expose individual mail box locks, a lock on the lock box designed so said postman's key can open both the postman's lock and said lock on the mail box to retract or extend a tongue into or out of said recess, whereby the lock bar can be moved out of the way in one direction, each tenant having a key designed to open said another lock in said lock box to retract or extend another tongue out of said recess so the lock bar can be moved out of the way in another direction to expose the individual mail box locks, said postman's lock designed so said tenant's key cannot open the postman's lock but the postman's key can open the postman's lock and actuate the lock on said lock box to retract or extend said tongue so he can move the lock bar out of the way permitting the individual mail boxes to pivot forward exposing their open tops and permitting them to be filled with mail, while the individual tenant's key can only open the tenant's lock on the lock box to retract or extend said tongue so the lock bar can be moved in another direction out of the way to expose the individual locks on said mail box.

* * * * *